US011840945B2

(12) United States Patent
Diaz Poueriet et al.

(10) Patent No.: US 11,840,945 B2
(45) Date of Patent: Dec. 12, 2023

(54) LUBRICATION FLUID STORAGE SYSTEM

(71) Applicant: Cummins Inc., Columbus, IN (US)

(72) Inventors: Pablo F. Diaz Poueriet, Columbus, IN (US); Ella Michelle Morris, Louisville, KY (US)

(73) Assignee: Cummins Inc., Columbus, IN (US)

( * ) Notice: Subject to any disclaimer, the term of this patent is extended or adjusted under 35 U.S.C. 154(b) by 54 days.

(21) Appl. No.: 17/651,122

(22) Filed: Feb. 15, 2022

(65) Prior Publication Data

US 2022/0290589 A1 Sep. 15, 2022

Related U.S. Application Data

(60) Provisional application No. 63/158,434, filed on Mar. 9, 2021.

(51) Int. Cl.

| | |
|---|---|
| ***F01M 11/00*** | (2006.01) |
| ***F01M 1/02*** | (2006.01) |
| ***F02F 1/24*** | (2006.01) |
| ***F01M 11/02*** | (2006.01) |

(52) U.S. Cl.

CPC ..... *F01M 11/0004* (2013.01); *F01M 11/02* (2013.01); *F02F 1/24* (2013.01); *F01M 2011/0037* (2013.01); *F01M 2011/0095* (2013.01); *F01M 2011/023* (2013.01)

(58) Field of Classification Search

CPC ..... F01M 11/0004; F01M 11/02; F01M 2011/0037; F01M 2011/0095; F01M 2011/023; F01M 2011/026; F02F 1/24

See application file for complete search history.

(56) References Cited

U.S. PATENT DOCUMENTS

| | | | | |
|---|---|---|---|---|
| 5,195,472 | A * | 3/1993 | Jacques | F01L 1/25 123/90.38 |
| 6,293,244 | B1 | 9/2001 | Mullins et al. | |
| 6,374,797 | B1 | 4/2002 | Fischer | |
| 7,025,032 | B2 * | 4/2006 | Barber | F01L 1/344 123/196 R |
| 7,484,484 | B2 | 2/2009 | Frincke et al. | |
| 8,201,538 | B2 | 6/2012 | Imazato | |
| 10,598,057 | B2 | 3/2020 | Lach et al. | |
| 10,647,312 | B2 * | 5/2020 | Ali | F28D 20/02 |
| 10,947,872 | B1 * | 3/2021 | Augustin, Sr. | F01M 11/0004 |
| 2011/0067669 | A1 * | 3/2011 | Sugiyama | F01M 13/022 123/196 R |
| 2015/0128889 | A1 * | 5/2015 | Konishi | F01L 1/3442 123/90.15 |
| 2015/0369098 | A1 * | 12/2015 | Barnes | F02F 1/24 123/193.5 |
| 2017/0138232 | A1 * | 5/2017 | Hellman | F01M 1/12 |
| 2019/0128156 | A1 * | 5/2019 | Clark | F01M 11/0004 |
| 2021/0079820 | A1 * | 3/2021 | Augustin, Sr. | F01M 11/0004 |
| 2022/0127981 | A1 * | 4/2022 | Otani | F01M 9/108 |

* cited by examiner

*Primary Examiner* — Kurt Philip Liethen

(74) *Attorney, Agent, or Firm* — Taft, Stettinius & Hollister LLP

(57) ABSTRACT

An internal combustion engine includes an engine lubrication fluid storage system with a primary storage volume and a secondary storage volume that is separate from the primary storage volume. The secondary storage volume is linked to the primary storage volume with a fluid flow path that is throttled so that lubrication fluid is stored in the secondary storage volume during engine operation, and drains from the secondary storage volume to the primary storage volume when the engine is not running.

20 Claims, 4 Drawing Sheets

LUBRICATION FLUID STORAGE SYSTEM

CROSS-REFERENCE TO RELATED APPLICATION

The present application claims priority to, and the benefit of the filing date of, U.S. Provisional Application Ser. No. 63/158,434 filed on Mar. 9, 2021, which is incorporated herein by reference.

FIELD OF THE INVENTION

This invention relates to an internal combustion engine including a lubrication system, and more particularly to a storage system for an engine lubrication fluid wherein the storage system is separate from the crankcase.

BACKGROUND

In an internal combustion engine, a supply of lubrication fluid, such as engine oil, is provided in a sump at the bottom of the engine. The cylinders and other moving components in an internal combustion engine require lubrication by oil or other suitable fluid to be able to operate properly. During engine operation, a pump is used to carry the lubrication fluid from the sump into the working portions of the engine in order to lubricate the engines moving parts and to provide other functions. The lubrication fluid is continuously supplied to these moving components, and the lubrication is fluid is returned to sump through various paths by gravity flow.

Lubrication fluid stored in the sump and/or crankcase while the engine is operating may interfere with operation of engine components, such as the connecting rods. Reducing this interference can reduce parasitic losses. Therefore, further improvements in lubrication fluid systems are needed.

SUMMARY

Embodiments disclosed herein include an internal combustion engine including an engine lubrication fluid storage system with a primary storage volume for providing lubrication fluid to an internal combustion engine and a secondary storage volume for retaining the lubrication fluid received from a cylinder head of the internal combustion engine. The secondary storage volume and the cylinder head are connected to the primary storage volume via a fluid flow path. The secondary storage volume includes a throttled outlet in fluid communication with the fluid flow path and the cylinder head includes a drain in fluid communication with the fluid flow path.

In an embodiment, the secondary storage volume is separate from the primary storage volume. In an embodiment, the secondary storage volume is provided in the cylinder head. In an embodiment, the fluid flow path is throttled so that a portion of the lubrication fluid is retained in the secondary storage volume during engine operation, and drains from the secondary storage volume into the primary storage volume when the engine is not operating. The secondary storage volume allows connecting rod dipping and fluid aeration to be avoided or reduced while providing the engine a sufficient quantity of lubrication fluid for operation.

In an embodiment, a system includes an internal combustion engine with a block, a cylinder head, a plurality of components in the cylinder head, and a lubrication fluid for lubricating the plurality of components. The system also includes a lubrication fluid storage system for storing a supply of the lubrication fluid to lubricate the plurality of components. The lubrication fluid storage system includes a primary storage volume for storing the lubrication fluid to circulate to the plurality of components of the internal combustion engine and a secondary storage volume in or adjacent to the cylinder head for storing a portion of the lubrication fluid circulated during operation of the internal combustion engine. A fluid flow path connects the secondary storage volume to the primary storage volume. The fluid flow path is throttled so that lubrication fluid is retained in the secondary storage volume during operation of the internal combustion engine. The lubrication in the secondary storage volume drains into the primary storage volume through the throttled fluid flow path in response to stopping operation of the internal combustion engine.

In an embodiment, a cylinder head for an internal combustion engine includes a body forming a compartment for housing a plurality of components of the internal combustion engine. The body includes a storage volume within or adjacent to the compartment. The storage volume is in fluid communication with the compartment via at least one inlet to permit lubrication fluid to drain from the compartment into the storage volume. The compartment includes a drain in fluid communication with a fluid flow path for the lubrication fluid, and the storage volume includes a throttled outlet in fluid communication with the fluid flow path.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
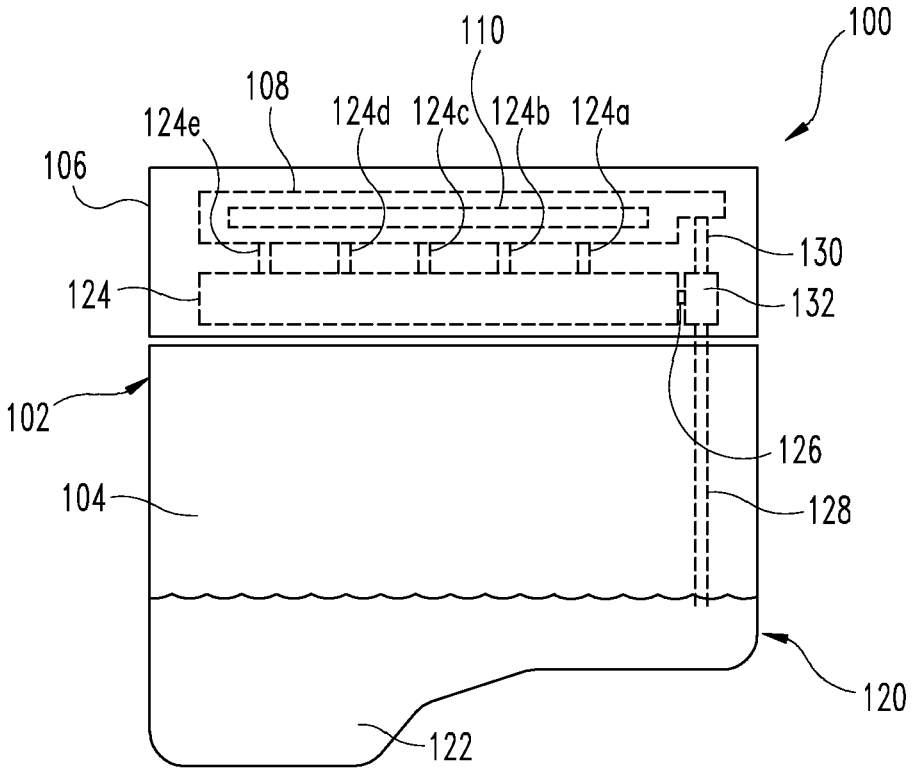
FIG. 1 is a schematic depiction of an internal combustion engine including a lubrication fluid storage system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1 an internal combustion engine system 100 includes an internal combustion engine 102 with a block 104 supporting a cylinder head 106. The block may house and/or supporting a plurality of components (not shown), such as crankshaft(s), a plurality of cylinders, pistons, gears, pumps, housings, turbines, etc. that would normally be found on an internal combustion engine. The cylinder head 106 includes a compartment 108 that houses a plurality of components 110 in cylinder head 106, such as valves, rockers, shafts, valve train parts, etc., normally associated with a cylinder head. The system 100 further includes a lubrication fluid storage system 120 that is mounted on-engine to receive lubrication fluid, such as oil, from cylinder head 106 and block 104 and to return the lubrication fluid to the plurality of components for lubrication and/or cooling.

The internal combustion engine 102 may be any type of internal combustion engine that requires lubrication, including at least a diesel, gasoline, or natural gas engine, and/or combinations thereof. The internal combustion engine 102 can include a single cylinder bank, a dual cylinder bank, or other cylinder bank arrangements. Any numbers of cylinders and cylinder arrangements are contemplated for internal combustion engine 102.

The lubrication fluid storage system 120 includes a primary storage volume 122 and a secondary storage volume 124 that each store lubrication fluid that is circulated through engine 102 and returned by gravity to primary storage volume 122. The primary storage volume 122 is a sump such as, for example, the crankcase and/or oil pan of engine 102. The secondary storage volume 124 is located within or adjacent to cylinder head 106 and stores a portion of the lubrication fluid circulated during operation of the internal combustion engine.

Lubrication fluid storage system 120 includes a fluid flow path 128 that connects the secondary storage volume 124 to the primary storage volume 122. The fluid flow path 128 is throttled so that lubrication fluid is retained in the secondary storage volume 124 during operation of the internal combustion engine 102. The lubrication fluid in secondary storage volume 124 drains into the primary storage volume 122 via gravity through the throttled fluid flow path 128 in response to stopping of the internal combustion engine 102.

In an embodiment, the secondary storage volume 124 and the cylinder head 106 are connected to the primary storage volume 122 via the fluid flow path 128. The secondary storage volume 124 includes a throttled outlet 126 in fluid communication with the fluid flow path 128 and the cylinder head 106 includes a drain 130 in fluid communication with the fluid flow path 128.

In an embodiment, cylinder head 106 includes compartment 108 and the secondary storage volume 124 in fluid communication with the compartment 108 via at least one inlet 124*a*, 124*b*, 124*c*, 124*d*, 124*e* into the secondary storage volume 124. The at least one inlet 124*a*, 124*b*, 124*c*, 124*d*, 124*e* permits lubrication fluid to drain from compartment 108 into the secondary storage volume 124. The compartment 108 also includes drain 130 for the lubrication fluid that is in fluid communication with fluid flow path 128. The secondary storage volume 124 includes throttled outlet 126 in fluid communication with the fluid flow path 128.

Secondary storage volume 124 forms a fluid capacitor that provides an additional volume for lubrication fluid storage during engine operation to allow a fluid level in primary storage volume 122 to be reduced more than would be possible with only the primary storage volume 122 available for lubrication fluid storage. The lowering of the fluid level in primary storage volume 122 can reduce or eliminated connection rod dipping, fluid aeration, and/or parasitic losses resulting from the same.

Secondary storage volume 124 can include multiple secondary storage volume inlets 124*a*, 124*b*, 124*c*, 124*d*, 124*e* fluidly connected to and located at least partially below compartment 108 to receive lubrication fluid therefrom. In an embodiment, the multiple inlets 124*a*, 124*b*, 124*c*, 124*d*, 124*e* are spaced along a length of the secondary storage volume to allow the secondary storage volume to rapidly fill with lubrication fluid after engine startup. The throttled outlet 126 of secondary storage volume 124 is fluidly connected to a drain collector 132, which is connected to the fluid flow path 128 extending to primary storage volume 122. The drain 130 of compartment 108 is positioned above throttled outlet 126, and is also fluidly connected to drain collector 132 so that lubrication fluid from compartment 108 drains to primary storage volume 122 via fluid flow path 128 in response to secondary storage volume 124 being filled with lubrication fluid.

Secondary storage volume 124 receives lubrication fluid from compartment 108 via inlets 124*a*-124*e* at a rate faster than fluid lubrication fluid is drained through throttled outlet 126 to primary storage volume 122 via fluid flow path 128. This allows the secondary storage volume 124 to fill with lubrication fluid during engine operation. Once secondary storage volume 124 is full, lubrication fluid in compartment 108 is provided to primary storage volume 122 via fluid flow path 128 to assist in maintaining the supply of lubrication fluid for recirculation while secondary storage volume 124 remains full of lubrication fluid. Once engine operation is stopped, the lubrication fluid in secondary storage volume 124 continues to flow through throttled outlet 126 and drain into primary storage volume 122 until the secondary storage volume 124 is effectively emptied.

Figure 2:
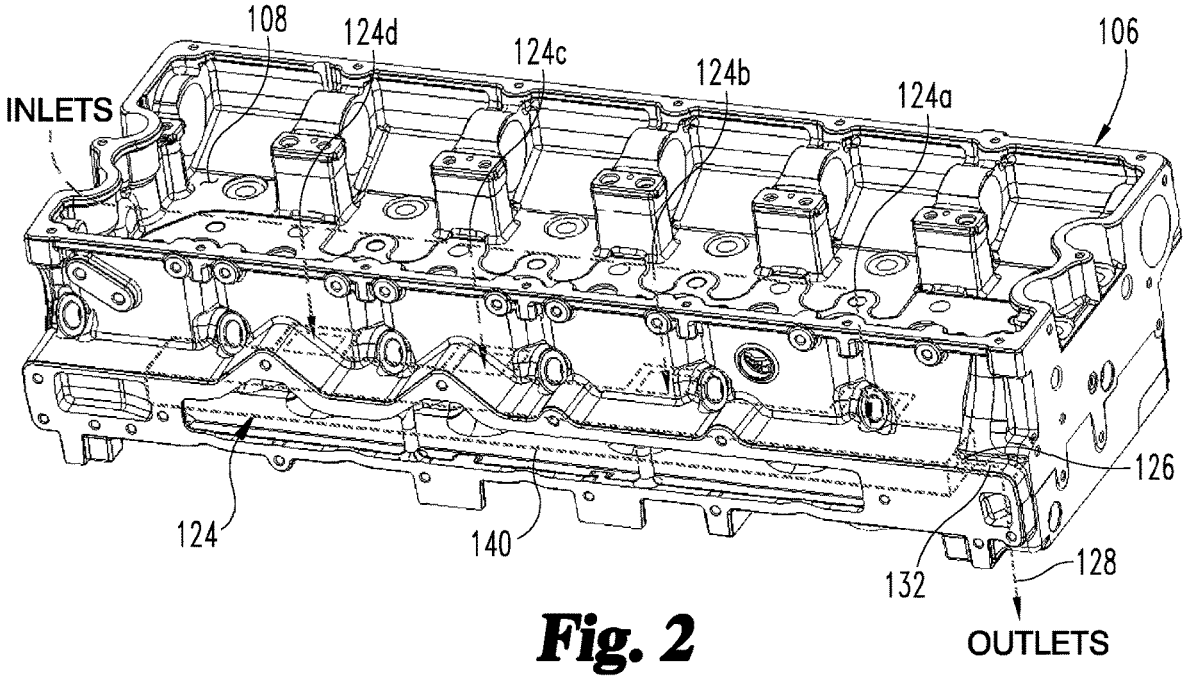
FIG. 2 is a perspective view of a cylinder head of the internal combustion engine of FIG. 1 showing the secondary storage volume.

As shown in FIG. 2, secondary storage volume 124 is located in a fluid drain cavity 140 of cylinder head 106 that is positioned within or adjacent to the compartment 108, which compartment 108 houses the plurality of components 110 as discussed above. In an embodiment, the secondary storage volume 124 and/or fluid drain cavity 140 is cast into cylinder head 106 during fabrication of the cylinder head 106. Secondary storage volume 124 and/or fluid drain cavity 140 may also be formed by other techniques, such as by machining the secondary storage volume 124 and/or fluid drain cavity 140 in the cylinder head 106, providing secondary storage volume 124 and/or fluid drain cavity 140 in a component attached to cylinder head 106, or forming secondary storage volume 124 and/or fluid drain cavity 140 in cylinder 106 using three-dimensional printing techniques.

The lubrication fluid supplied to compartment 108 for lubrication of the plurality of components 110 drains into the fluid drain cavity 140 via the plurality of inlets 124*a*-124*e*. The throttled outlet 126 is located at an end of the fluid drain cavity 140 adjacent the fluid flow path 128. Throttled outlet 126 opens into drain collector 132 that collects lubrication fluid from throttled outlet 126 and from compartment drain 130 to provide the lubrication fluid to fluid flow path 128. In an embodiment, drain 130 is located above drain collector 132 and throttled outlet 126. Although one drain cavity 140 is shown for the secondary storage volume 124, it is contemplated that multiple drain cavities may be provided that are connected to one another and/or to one or more throttled outlet(s) 126.

Figure 3:
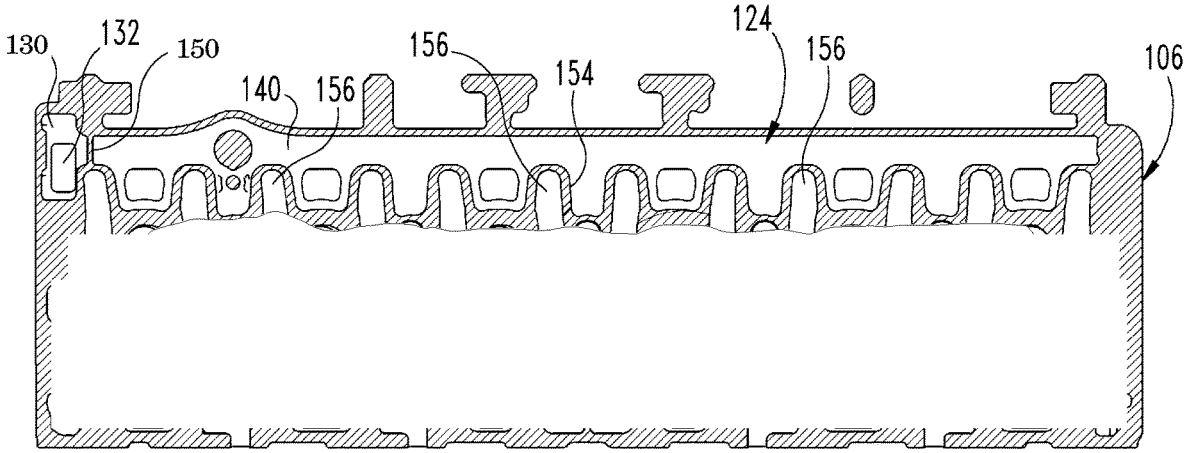
FIG. 3 is a section view of the cylinder head of FIG. 2 showing the secondary storage volume in the cylinder head.
Figure 4:
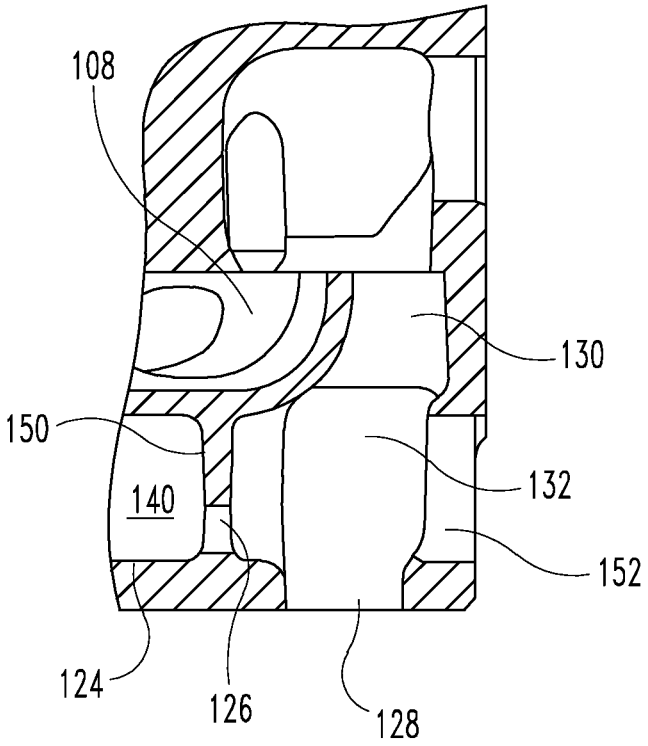
FIG. 4 is another section view of the cylinder head of FIG. 2 showing the throttled outlet of the secondary storage volume and the drain into the fluid flow path to the primary storage volume.

Referring further to FIGS. 3-4, secondary storage volume 124 includes a divider wall 150 at one end thereof that separates secondary storage volume 124 from drain collector 132. Throttled outlet 126 extends through a bottom part of divider wall 150. A hole 152 can be provided in cylinder head 106 to facilitate formation of throttled outlet 126 in divider wall 150, which hole 152 can be subsequently plugged.

Wall 154 of secondary storage volume 124 can have a serpentine shape to provide additional surface area for contact with portions of cooling jacket(s) 156 of cylinder head 106. In an embodiment, wall 154 is located between secondary storage volume 124 and compartment 108. The serpentine shape facilitates heat transfer with the lubrication fluid stored in secondary storage volume 124 and/or other parts of drain cavity 140.

During engine operation, lubrication fluid draining from compartment 108 flows into drain cavity 140 via inlets 124*a*-124*e* at a faster rate than lubrication fluid flows out of throttled outlet 126 into drain collector 132. Once drain cavity 140 is filled with lubrication fluid, the lubrication fluid in compartment 108 flows into drain collector 132 via compartment drain 130. The lubrication fluid in drain collector 132 is provided to the primary storage volume 122 via fluid flow path 128.

When engine operation is stopped, lubrication fluid continues to flow from drain cavity 140 through throttled outlet 126 until the drain cavity 140 is effectively empty. This allows all the lubrication fluid of system 100 to be drained from primary storage volume 122 for servicing and replacement without having a significant volume of lubrication fluid trapped in secondary storage volume 124.

In an embodiment, the throttled outlet 126 is sized to allow the lubrication fluid to drain at a rate which does not increase, or significantly increase, the time for draining the lubrication fluid from the overall system 100 during a service event. In an embodiment, secondary storage volume is configured to temporarily retain up to 10% of the overall volume of lubrication fluid. However, it should be appreciated that other drain rates and/or storage capacities for secondary storage volume 124 are also contemplated.

Various aspects of the present disclosure are contemplated as indicated in the claims appended hereto. According one aspect, a system includes an internal combustion engine including a block, a cylinder head, a plurality of components in the cylinder head, and a lubrication fluid for lubricating the plurality of components. The engine includes a lubrication fluid storage system for storing a supply of the lubrication fluid to lubricate the plurality of components. The lubrication fluid storage system includes a primary storage volume for storing the lubrication fluid to circulate to the plurality of components of the internal combustion engine, a secondary storage volume in the cylinder head for storing a portion of the lubrication fluid circulated during operation of the internal combustion engine, and a fluid flow path connecting the secondary storage volume to the primary storage volume. The fluid flow path is throttled so that lubrication fluid is retained in the secondary storage volume during operation of the internal combustion engine. The lubrication in the secondary storage volume drains into the primary storage volume through the throttled fluid flow path in response to stopping operation of the internal combustion engine.

In an embodiment, the secondary storage volume is located within the cylinder head. In an embodiment, the cylinder head includes a compartment housing the plurality of components, and the compartment is in fluid communication with the secondary storage volume via a plurality of inlets into the secondary storage volume.

In an embodiment, the secondary storage volume is located at least partially below the compartment of the cylinder head. In an embodiment, the compartment includes a drain in fluid communication with the fluid flow path, and lubrication fluid from the compartment drains to the primary storage volume via the drain in response to the secondary storage volume being full of lubrication fluid. In an embodiment, the secondary storage volume includes a divider wall with a throttled outlet in fluid communication with the fluid flow path.

In an embodiment, the fluid flow path extends through the block from the cylinder head to the primary storage volume. In an embodiment, the primary storage volume is a sump below the block. In an embodiment, the secondary storage volume includes at least one wall with a serpentine shape that is located between the secondary storage volume and the compartment. In an embodiment, the lubrication fluid drains into the secondary storage volume faster than a rate of drainage of the lubrication fluid through the throttled fluid flow path.

In another aspect, a lubrication system for an internal combustion engine includes a primary storage volume for providing lubrication fluid to an internal combustion engine, and a secondary storage volume for retaining the lubrication fluid received from a cylinder head of the internal combustion engine. The secondary storage volume and the cylinder head are connected to the primary storage volume via a fluid flow path. The secondary storage volume includes a throttled outlet in fluid communication with the fluid flow path and the cylinder head includes a drain in fluid communication with the fluid flow path.

In an embodiment, the secondary storage volume is located in a fluid drain cavity of the cylinder head below a compartment in the cylinder head. In an embodiment, the cylinder head includes a compartment for housing a plurality of engine components In an embodiment, the compartment is in fluid communication with the secondary storage volume via a plurality of inlets that are spaced along the secondary storage volume to drain lubrication fluid from the compartment into the secondary storage volume.

In an embodiment, the lubrication fluid drains via gravity to the primary storage volume through the fluid flow path. In an embodiment, the cylinder head includes a drain collector that fluidly connects the throttled outlet and the drain with the fluid flow path. In an embodiment, the throttled outlet is provided in a wall separating the secondary storage volume from the drain collector. In an embodiment, the drain is above the drain collector and the throttled outlet.

In another aspect, a cylinder head for an internal combustion engine includes a body forming a compartment for housing a plurality of components of the internal combustion engine. The body includes a storage volume below the compartment, and the storage volume is in fluid communication with the compartment via at least one inlet to permit lubrication fluid to drain from the compartment into the storage volume. The compartment also includes a drain in fluid communication with a fluid flow path for the lubrication fluid, and the storage volume includes a throttled outlet in fluid communication with the fluid flow path.

In an embodiment, the body of the cylinder head includes a drain collector, and the drain is connected to the drain collector above a connection of the throttled outlet to the drain collector.

In an embodiment, the storage volume includes multiple inlets from the compartment for receiving lubrication fluid from the compartment, and the storage volume includes at least one wall having a serpentine shape that is located between the compartment and the storage volume.

Any of the embodiments disclosed herein may be combined with one or more other embodiments unless otherwise excluded.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine including a block, a cylinder head, a plurality of components in the cylinder head, and a lubrication fluid for lubricating the plurality of components;

a lubrication fluid storage system for storing a supply of the lubrication fluid to lubricate the plurality of components, the lubrication fluid storage system including:

a primary storage volume for storing the lubrication fluid to circulate to the plurality of components of the internal combustion engine;

a secondary storage volume in or adjacent to the cylinder head for storing a portion of the lubrication fluid circulated during operation of the internal combustion engine;

a fluid flow path connecting the secondary storage volume to the primary storage volume, wherein:

the secondary storage volume includes a throttled outlet in fluid communication with the fluid flow path to throttle the fluid flow path so that lubrication fluid is retained in the secondary storage volume during operation of the internal combustion engine; and the lubrication fluid in the secondary storage volume drains into the primary storage volume through the throttled outlet and the fluid flow path in response to stopping operation of the internal combustion engine.

2. The system of claim 1, wherein the secondary storage volume is located within the cylinder head.

3. The system of claim 1, wherein the cylinder head includes a compartment housing the plurality of components, and the compartment is in fluid communication with the secondary storage volume via a plurality of inlets into the secondary storage volume.

4. The system of claim 3, wherein the secondary storage volume is located at least partially below the compartment of the cylinder head.

5. The system of claim 3, wherein the compartment includes a drain in fluid communication with the fluid flow path, and the compartment and secondary storage volume are configured so lubrication fluid from the compartment drains to the primary storage volume via the drain in response to the secondary storage volume being full of lubrication fluid.

6. The system of claim 5, wherein the secondary storage volume includes a divider wall including the throttled outlet in fluid communication with the fluid flow path.

7. The system of claim 1, wherein the fluid flow path extends through the block from the cylinder head to the primary storage volume.

8. The system of claim 1, wherein the primary storage volume is a sump below the block.

9. The system of claim 1, wherein the secondary storage volume includes at least one wall with a serpentine shape that is located between the secondary storage volume and the compartment.

10. The system of claim 1, wherein the lubrication fluid drains into the secondary storage volume faster than a rate of drainage of the lubrication fluid through the throttled fluid flow path.

11. A lubrication system for an internal combustion engine, comprising:

a primary storage volume for providing lubrication fluid to an internal combustion engine; and a secondary storage volume for retaining the lubrication fluid received from a cylinder head of the internal combustion engine, wherein the secondary storage volume and the cylinder head are connected to the primary storage volume via a fluid flow path, wherein the secondary storage volume includes a throttled outlet in fluid communication with the fluid flow path and the cylinder head includes a drain in fluid communication with the fluid flow path, wherein the secondary storage volume and cylinder head are configured so lubrication fluid in the secondary storage volume drains into the primary storage volume through the throttled outlet and the fluid flow path, and the lubrication fluid in the cylinder head drains into the primary storage volume through the drain and the fluid flow path once the secondary storage volume is filled with lubrication fluid.

12. The lubrication system of claim 11, wherein the secondary storage volume is located in a fluid drain cavity of the cylinder head below a compartment in the cylinder head, the compartment housing a plurality of components for the cylinder head.

13. The lubrication system of claim 12, wherein the compartment of the cylinder head is in fluid communication with the secondary storage volume via a plurality of inlets that are spaced along the secondary storage volume to drain lubrication fluid from the compartment into the secondary storage volume.

14. The lubrication system of claim 11, wherein the lubrication fluid drains via gravity to the primary storage volume through the fluid flow path.

15. The lubrication system of claim 11, wherein the cylinder head includes a drain collector that fluidly connects the throttled outlet and the drain with the fluid flow path.

16. The lubrication system of claim 15, wherein the throttled outlet is provided in a wall separating the secondary storage volume from the drain collector.

17. The system of claim 15, wherein the drain is above the drain collector and the throttled outlet.

18. A cylinder head for an internal combustion engine, comprising:

a body forming a compartment for housing a plurality of components of the internal combustion engine, the body including a storage volume within or adjacent to the compartment, wherein the storage volume is in fluid communication with the compartment via at least one inlet to permit lubrication fluid to drain from the compartment into the storage volume, and further wherein the compartment includes a drain in fluid communication with a fluid flow path for the lubrication fluid and the storage volume includes a throttled outlet in fluid communication with the fluid flow path, wherein the secondary storage volume and cylinder head are configured so lubrication fluid in the secondary storage volume drains into the primary storage volume through the throttled outlet and the fluid flow path, and the lubrication fluid in the cylinder head drains into the primary storage volume through the drain and the fluid flow path once the secondary storage volume is filled with lubrication fluid.

19. The cylinder head of claim 18, wherein the body of the cylinder head includes a drain collector, and the drain is connected to the drain collector above a connection of the throttled outlet to the drain collector.

20. The cylinder head of claim 18, wherein the storage volume includes multiple inlets from the compartment for receiving lubrication fluid from the compartment, and the storage volume includes at least one wall having a serpentine shape that is located between the compartment and the storage volume.

* * * * *